US005584609A

United States Patent [19]

Clarey et al.

[11] Patent Number: 5,584,609

[45] Date of Patent: Dec. 17, 1996

[54] GEOSYNTHETIC CLAY LINER AND METHOD OF MANUFACTURE

[75] Inventors: Mark Clarey, Dalton; Donald Mathews, Radal, both of Ga.

[73] Assignee: Claymax Corporation, Ill.

[21] Appl. No.: 416,273

[22] Filed: Apr. 4, 1995

[51] Int. Cl.[6] ..... E02D 3/12

[52] U.S. Cl. ..... 405/270; 264/109; 405/129; 428/87

[58] Field of Search ..... 405/129, 270; 428/87, 913; 264/109, 112

[56] References Cited

U.S. PATENT DOCUMENTS

| | | | |
|---|---|---|---|
| 5,174,231 | 12/1992 | White | 210/679 X |
| 5,237,945 | 8/1993 | White | 264/109 X |
| 5,346,566 | 9/1994 | White | 405/270 X |
| 5,350,255 | 9/1994 | Carriker | 405/270 |
| 5,360,294 | 11/1994 | Carriker et al. | 405/270 |
| 5,403,126 | 4/1995 | Carriker et al. | 405/270 |
| 5,436,050 | 7/1995 | Carriker et al. | 405/129 X |

FOREIGN PATENT DOCUMENTS

| | | |
|---|---|---|
| 0278419A3 | 8/1988 | European Pat. Off. . |
| 0606700A1 | 7/1994 | European Pat. Off. . |
| WO94/05863 | 3/1994 | WIPO . |

*Primary Examiner*—George A. Suchfield
*Attorney, Agent, or Firm*—Marshall, O'Toole, Gerstein, Murray & Borun

[57] ABSTRACT

An improved method of manufacturing geosynthetic clay liners is provided. The method of manufacture enables the construction of a structurally sound liner without the use of glue or adhesive and further without the use of needle punching or quilting. The method of manufacture also eliminates the need for any subsequent drying step. Water in combination with compression is used to adhere the granular bentonite layer to the inside surfaces of the cover sheet and the primary carrier sheet and further to provide structural stability to the bentonite layer itself.

11 Claims, 1 Drawing Sheet

GEOSYNTHETIC CLAY LINER AND METHOD OF MANUFACTURE

FIELD OF THE INVENTION

This invention relates generally to improved geosynthetic clay liners which are manufactured without the use of glue or adhesives and further without the use of needle punching, quilting or an equivalent means for holding the bentonite layer in place between the primary carrier sheet and the cover sheet. Still more specifically, the present invention relates to an improved method of manufacturing a geosynthetic clay liner whereby water or moisture is used in combination with compression to adhere the primary carrier sheet, the bentonite layer and the cover sheet together as a relatively cohesive unit.

BACKGROUND

Geosynthetic clay liners made with bentonite are used to form impermeable barriers in landfills and man-made bodies of water. The present invention addresses a problem associated with the manufacture of such geosynthetic clay liners. Specifically, the present invention addresses the problem of how to get the bentonite granules to adhere to the primary carrier sheet, the cover sheet as well as to adjacent bentonite granules in order to form a flexible yet cohesive liner.

By way of background, a geosynthetic clay liner (GCL) is comprised of three primary structural components: (1) the primary carrier sheet, also known as the primary backing, primary textile or primary carrier; (2) the cover sheet, also known as the secondary textile, secondary carrier sheet or scrim; and (3) a layer of granular bentonite disposed therebetween.

The primary carrier sheet is normally the lower sheet of material that engages the ground or surface on which the GCL is installed. The cover sheet is normally the upper sheet of material that engages either the landfill material, water or other material that is deposited on top of the GCL once installed. Bentonite is a naturally occurring clay material which tends to expand upon being exposed to water. When a layer of dry bentonite is wetted, the bentonite layer is capable of substantially precluding the migration of liquids through the bentonite layer if it is properly contained. One way to ensure proper containment of the bentonite material in a landfill or man-made body of water is to provide the bentonite in the form of a GCL whereby the primary carrier sheet and cover sheet act to contain the granular bentonite after it is wetted and ensure that an impermeable barrier is created by the swollen layer of bentonite clay.

The present invention addresses problems associated in preventing movement or displacement of the granular bentonite once the GCL is constructed. Specifically, considering that a GCL comprises a layer of granule bentonite disposed between a primary carrier sheet and a cover sheet, it is evident that movement or displacement of the granule bentonite between the primary carrier sheet and the cover sheet will occur unless some means for containing or maintaining the position of the bentonite granules is provided.

At least one manufacturer uses glue or adhesive to connect or attach the bentonite granules to the cover sheet and/or to the primary carrier sheet. If this technique is used, the manufacturer is assured that at least a portion of the bentonite granules will be disposed continuously across the cover sheet and the primary carrier sheet, even though some bentonite granules disposed in the middle of the bentonite layer may move or shift during shipment and handling due to insufficient infiltration of the glue or adhesive into the bentonite layer.

The disadvantages to using glue as a means for holding the components of the GCL together are twofold. First, the use of glue increases the cost of manufacture of GCLs because it is a time-consuming manufacturing process. The glue must be applied to the primary carrier sheet before the bentonite is placed on top of the primary carrier sheet. Additional applications of glue to the bentonite and to the cover sheet are also required. Then, the glue must be dried, a procedure which requires expensive equipment and which has significant energy costs. While the use of glue has the benefit of holding the bentonite granules in place, the use of glue as a sole means for holding the liner together may require repeated applications of glue, which is expensive in terms of manufacturing time, and further involves substantial energy consumption in the drying process, which is expensive in terms of energy costs.

Other manufacturers use needle punching and/or quilting as a means for holding a GCL together. The needle punching process requires the use of at least one non-woven fabric for the cover sheet or the primary carrier sheet. The non-woven fibers are pulled by the needles to interlock with the adjacent fabric sheet. Non-woven fabrics have lower tensile strengths than woven fabrics and have higher lateral transmissivity than woven fabrics and therefore non-woven fabrics are not as preferable for use in GCLs as woven fabrics. Non-woven fabrics are simply not as strong or as durable as woven fabrics and therefore needle punching non-woven fabrics together with a layer of bentonite disposed therebetween is not a preferable method of manufacturing GCLs.

Quilting is another method of holding the bentonite layer in place. In a quilted GCL, the primary carrier sheet and cover sheet are sewn together in an intersecting pattern. The bentonite is held in place in sewn pockets or compartments. Quilting is not preferable because of the excessive amount of sewing required which drives up the cost of the finished product. Further, within each pocket formed by a quilt-like pattern, there may be shifting of the bentonite. This can result in locations of high permeability.

Thus, it would be highly advantageous to the geosynthetic clay liner industry if a process for manufacturing geosynthetic clay liners was provided that (1) avoided the use of glue or adhesives altogether, (2) avoided the use of needle punching, (3) avoided quilting or equivalents thereof. The present invention makes a significant contribution in this respect by providing a manufacturing process that utilizes woven primary carrier and cover sheets or the use of film-type material such as polyethylene or polypropylene for the primary carrier and cover sheets and which relies on the adhesive properties of moistened bentonite itself to hold the bentonite in place. The edges of the primary carrier and cover sheets may be sewn together in a conventional manner; needle punching, quilting or gluing is not required. It should be noted that it may be advantageous to add longitudinally disposed rows of stitching between upper and lower fabrics to improve the shear resistance of the GCL when it is expected that the GCL will be used on a slope. The longitudinal stitching, however, is not intended to provide any significant resistance to localized shifting of the bentonite granules during transport of the GCL from the point of its manufacture to the site at which it is to be installed.

SUMMARY OF THE INVENTION

The present invention provides a significant contribution to the art of manufacturing geosynthetic clay liners because it provides a means for manufacturing geosynthetic clay liners without the use of glue and without the use and without the use of needle punching or quilting. The liner provided by the present invention is bonded or held together with the use of water or moisture and pressure. When used in this specification, the terms "glue" and "adhesive" are not intended to include moistened bentonite or moistened and dried bentonite although moistened bentonite does have a sticky consistency and moistened and dried bentonite will clearly adhere to certain materials. The terms "glue" and "adhesive" are used herein as a reference to materials other than bentonite which have adhesive properties.

Specifically, in broad outline, the method of manufacture provided by the present invention includes three primary steps. First, the GCL is constructed by placing a layer of bentonite granules on top of a primary carrier sheet or cover sheet and thereafter placing the cover sheet or primary carrier sheet on top of the bentonite layer. Water is applied to the bentonite as well as to the primary carrier sheet and cover sheet. The application of water may be provided in a number of steps. First, water may be applied to the inside surface of the primary carrier sheet before the layer of bentonite is deposited thereon. Water may also be applied to the inside surface of the cover sheet before the cover sheet is deposited on top of the layer of bentonite granules. Further, once the layer of bentonite granules is deposited on top of the primary carrier sheet, water is applied to the bentonite layer. If enough water is applied to the bentonite layer, it is foreseeable that separate applications of water to the primary carrier sheet and cover sheet may be eliminated.

The geosynthetic clay liner is held together by passing the primary sheet, bentonite layer, cover sheet with water applied thereto through a compression means. The preferred method of compressing or consolidating the GCL is a pair of opposingly directed compression rollers which squeeze the GCL together which causes some of the bentonite granules to adhere to the inside surface of the cover sheet, some of the bentonite granules to adhere to the inside surface of the primary carrier sheet and some of the bentonite granules to adhere to adjacent bentonite granules, depending upon the location of the specific bentonite granules in the bentonite layer. It is believed that compression of the GCL while the bentonite is moist causes dispersion of the moisture to all or nearly all of the bentonite, thus improving the extent to which the moisture is evenly distributed within the bentonite layer.

The process of the present invention takes advantage of the fact that partially wetted bentonite granules, which are not saturated with enough moisture to cause undue amounts of swelling, will acquire a sticky or tacky physical characteristic which causes those wetted bentonite granules to adhere to the inside surface of the cover sheet, the inside surface of the primary carrier sheet and adjacent bentonite granules. The sticky or tacky characteristic acquired by the wet bentonite granules is the physical phenomena which holds the GCL together to provide a consolidated GCL. No separate gluing or application of adhesive is required. No undue amounts of sewing are required; only the edges of the primary carrier sheet and cover sheets need to be sewn together. No quilting or needle punching is required or desirable.

An alternative and additional method of manufacture provided by the present invention is directed to enhancing the ability of the inside surfaces of the cover sheet and primary carrier sheet to adhere to the wetted bentonite granules. Specifically, the inside surfaces of the cover sheet and/or the primary carrier sheet may be exposed to a knapp lifting roller means or knapp rollers to cause outwardly protruding knapp threads or fibers on those inside surfaces. The outwardly protruding knapp enhances the ability of wetted bentonite granules to adhere to the inside surface of the textile material (i.e., the inside surfaces of the cover sheet or primary carrier sheet). Essentially, providing knapp on the inside surfaces of the cover and/or primary carrier sheet provides a fuzzy quality to those inside surfaces. It has been discovered through the testing of the manufacturing methods provided by the present invention that the knapp or fuzzy quality provided at the inside surfaces of the cover sheet and primary carrier sheet provided by a knapp roller improves the adherence of wetted bentonite granules to those inside surfaces and, in turn, increases the internal shear strength of the fabricated product.

Thus, the method of manufacture provided by the present invention may also include the additional step of exposing the inside surface of the primary carrier sheet to a knapp roller so that the inside surface is provided with an upwardly protruding knapp for better adherence to the wetted bentonite granules. Further, the method of manufacture of the present invention may also include the additional step of exposing the inside surface of the cover sheet to a knapp roller to produce downwardly extending knapp on the inside surface of the cover sheet for better adherence of the inside cover sheet to wetted bentonite granules. The exposure of the inside surfaces of the primary carrier sheet and the cover sheet to their respective knapp rollers may be performed prior to or after an initial application of water to the inside surfaces of the primary carrier sheet and cover sheets. In the preferred method, the inside surfaces of both textile sheets is first wetted, prior to exposure of those inside surfaces to knapp rollers.

The compression of the GCL while the bentonite is moist not only disperses the moisture (as discussed above), but also has the additional benefit of ensuring that the bentonite will engage the fibers extending from the carrier and cover sheets, which will result in a good bond or grip between the bentonite layer and the fabrics adjacent thereto.

The present invention also provides an improved geosynthetic clay liner which includes a primary carrier sheet, a cover sheet with a layer of compressed bentonite granules disposed therebetween. The compressed bentonite granules will have a moisture content of between about 20 to about 30 weight percent. This relatively high moisture content will enable the compressed bentonite granules to adhere to the inside surfaces of the primary carrier sheet and cover sheet and will result in a geosynthetic clay liner manufactured without glue and without needle punching or quilting but with an improved structural integrity. The inside surfaces of the primary carrier sheet and cover sheet of the improved GCL of the present invention may also include fibers which extend from their respective inside surfaces toward the compressed bentonite granules to enhance the adherence of the compressed bentonite granules to the inside surfaces of the primary carrier sheet and cover sheet.

It is therefore an object of the present invention to provide an improved method of manufacturing geosynthetic clay liners.

Another object of the present invention is to provide a method of manufacturing geosynthetic clay liners without the use of adhesive materials still further without the use of needle punching or quilting techniques.

Yet another object of the present invention is to provide a geosynthetic clay liner with improved structural integrity that is also made without the use of glue, needle punching or quilting processes.

Another object of the present invention is to provide a more efficient method of manufacturing geosynthetic clay liners.

Other features and advantages of the present invention will be apparent from the following description in conjunction with the accompanying drawings.

BRIEF DESCRIPTION OF THE DRAWINGS

This invention is illustrated more or less diagrammatically in the accompanying drawings, wherein.

Figure 1:
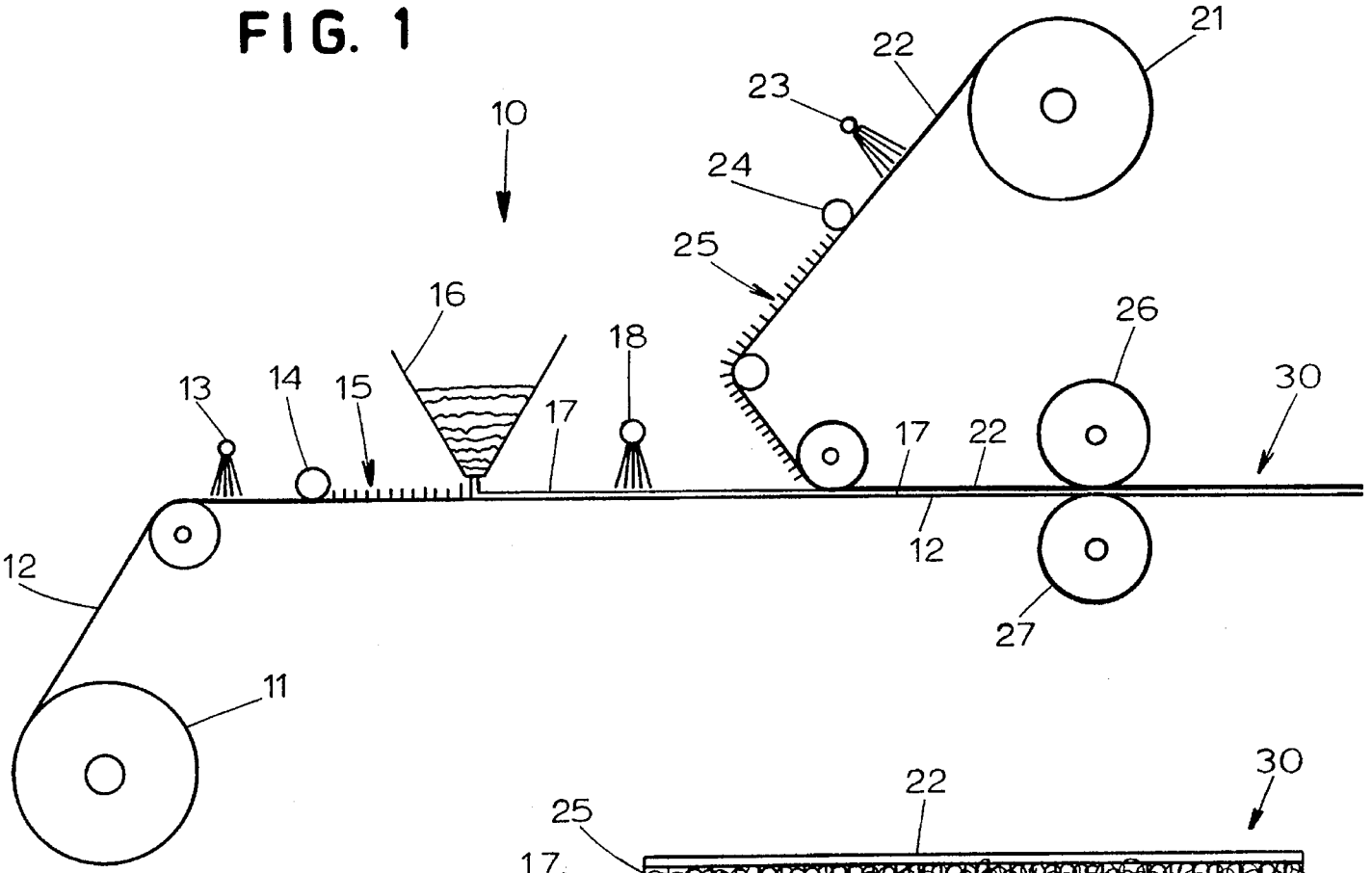
FIG. 1 is a schematic view of a manufacturing process in accordance with the present invention.

it should be understood that the above drawings are not necessarily to scale and that the manufacturing steps are sometimes illustrated by graphic symbols and diagrammatic representations. In certain instances, details which are not necessary for an understanding of the present invention or which render other details difficult to perceive may have been omitted. It should be understood, of course, that the invention is not necessarily limited to the particular processes or embodiments illustrated herein.

DETAILED DESCRIPTION OF THE INVENTION

Like reference numerals will be used to refer to like or similar parts from Figure to Figure in the following description of the drawings.

The dramatic improvement contributed by the present invention is best understood after consideration of the prior art. Specifically, when a woven fabric is used for the primary carrier sheet or cover sheet, processes known in the art rely upon the use of glue to adhere the bentonite to the primary carrier sheet and cover sheet and further, to increase the structural integrity of the liner. As noted above, the use of glue is expensive in terms of manufacturing time, materials, costs and energy costs. Thus, the ability to manufacture a GCL with woven primary carrier and cover sheets without the use of glue is a substantial improvement.

Also as noted above, GCLs have been fabricated in the past using needle punching systems. However, needle punching requires that at least one of the sheets, either the primary carrier or cover sheet, and preferably both sheets, to be manufactured from non-woven fibrous material. The use of the woven sheets provided by the present invention is superior to the non-woven fibrous material due to the structural integrity and strength of woven materials.

Finally, it will be noted that quilted GCLs have been manufactured in the past without the use of glue or adhesive but the solution provided by the present invention is a substantial advance over these liners because quilting requires substantial additional sewing which is expensive in terms of manufacturing time and equipment costs, and because a quilted liner is susceptible to the formation of localized "bare spots" from which the bentonite has shifted.

The improved manufacturing process provided by the present invention is illustrated generally in FIG. 1. The manufacturing line or apparatus shown generally at 10 starts at the left with a roll of primary fabric 11. The roll of primary fabric 11 may be used for the primary carrier sheet which is generally considered to be the bottom sheet or the sheet that engages the ground when the liner is installed, or the cover sheet which is generally considered to be the top sheet. For purposes of illustration, we will assume that the roll of material shown at 11 is the fabric to be utilized for the primary carrier sheet shown at 12. The sheet 12 is then unrolled from the roll 11 before it is exposed to the water spray shown at 13 which applies a coating of water to the inside surface (not shown) of the primary carrier sheet 12. The wetted sheet 12 is then exposed to a knapp lifting roller 14 which can essentially be a brush apparatus and which causes upwardly protruding knapp shown generally at 15 to extend upward from the inside surface of the primary carrier sheet 12. As noted above, the knapp 15 enhances the ability of wetted bentonite granules to adhere to the inside surface of the primary carrier sheet 12. It will also be noted that the spraying step shown at 13 and the knapp lifting step shown at 14 may be reversed.

The wetted and knapped carrier sheet 12 is then traversed underneath a bentonite dispenser shown at 16 which deposits a layer of bentonite 17 on the inside surface of the primary carrier sheet 12. The primary carrier sheet with the layer of bentonite 17 disposed thereon is then traversed underneath a second water spray 18 which applies a substantial spray of water to the bentonite layer 17. The bentonite granules are wetted but not saturated with water. The roll of fabric shown at 21 is used for the cover sheet 22. The cover sheet material 22 is unrolled and then exposed to a water spray 23 before it is exposed to a knapp lifting roller 24. Of course, the water spray step 23 and the knapp lifting roller step 24 may also be reversed. The knapp lifting roller causes knapp 25 to extend downwardly from the inside surface of the cover sheet 22 in a direction toward the bentonite layer 17. After the cover sheet 22 is deposited on top of the bentonite layer 17, the primary carrier sheet 12, the bentonite layer 17 and the cover sheet 22 are all passed through the compression rollers shown at 26 and 27. In actual practice, a series of compression rollers like those shown at 26 and 27 may be utilized to prevent buildup or damming of the granular bentonite between the cover sheet 22 and primary carrier sheet 12. The compression of the wetted layer of bentonite granules 17 between the cover sheet 22 and primary carrier sheet 12 causes the bentonite granules to adhere to one another as well as to the inside surfaces of the cover sheet 22 and primary carrier sheet 12. The resulting liner shown at 31 is ready to be rolled up and transported. No heating or drying operation is necessary. The optimum moisture content of the bentonite has been achieved. A geosynthetic clay liner 30 with structural integrity and internal shear strength has been created without the use of adhesive, additional drying steps, needle punching or quilting.

It will be noted that not only can the water spray 13 and knapp roller 14 be reversed, both operations may be eliminated and the process will still fall within the scope of the present invention. Similarly, not only can the sprayer 23 and knapp roller 24 be reversed, both operations may also be eliminated. Still further, the roll 11 may also provide the material for the cover sheet as opposed to the primary carrier sheet and the roll 21 may provide the material for the primary carrier sheet as opposed to the cover sheet.

Figure 2:
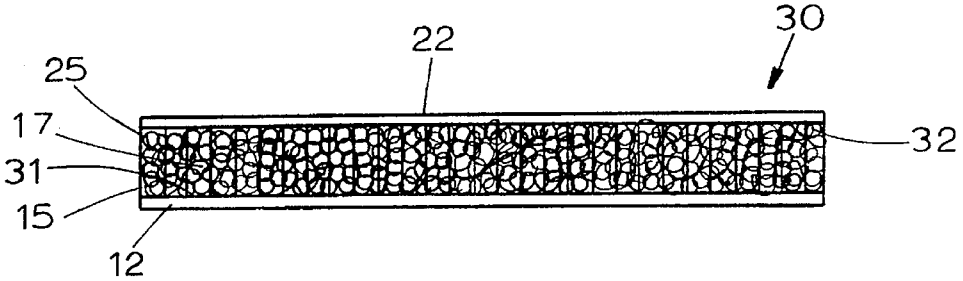
FIG. 2 is a side sectional view of a geosynthetic clay liner made in accordance with the present invention.

A sectional view of the geosynthetic clay liner 30 is illustrated in FIG. 2. The primary carrier sheet 12 includes an inside surface 31 from which the knapp 15 (see also FIG. 1) extends upward toward the bentonite layer 17. The cover sheet or secondary sheet 22 also includes an inside surface 32 which includes the knapp 25 (see also FIG. 1) which extends downward toward the bentonite layer 17. The knapp 25 (see also FIG. 1) of the cover sheet enhances the bond between the wetted granular bentonite 17 and the inside surface 32 of the cover sheet 22. Similarly, the knapp 15 (see also FIG. 1) of the primary carrier sheet 12 enhances the bond between the wetted granular bentonite layer 17 and the inside surface 31 of the primary carrier sheet 12.

It will be noted that the thickness of the bentonite layer is dependent upon the bentonite density and is not a critical parameter of this process. Further, it will be noted that the amount of water used at the sprayer 18 as well as the total amount of water provided by the sprayers 13, 18 and 23 will vary with the bentonite density. Further, it may also be useful to include a swelling inhibitor in the water provided by the sprayer 18 to decrease the likelihood of any premature swelling in the bentonite layer 17. Suitable swelling inhibitors include EZ-MUD and EZDP polymeric formation stabilizers sold by Baroid Corporation. The preferred final moisture content of the GCL 30 is between 10% and 30% and is preferably about 25%. Again, no drying of the final GCL product 30 is necessary. By wetting the bentonite to a moisture content of between 20% and 30%, the bentonite acquires the desired sticky or tacky characteristics needed for sufficient bonding between the bentonite granules themselves and between the primary carrier sheet 12 and cover sheet 22. The preferred size of the bentonite granules is between 4 mesh and 16 mesh.

The pressure imposed by the rollers 26, 27 should be between about 45 and 85 pounds per linear inch (pli) and preferably about 65 pli. This pressure is achieved through a total compressive force of 10,700 lbs. distributed along a "nip" length of 166 in.

A wide variety of materials may be used for the primary carrier sheet 12 and cover sheet 22. However, as noted above, woven materials are preferred due to their durability and strength. Two woven geotextile fabrics known to be effective for the primary carrier sheet 12 and cover sheet 22 are sold under the trademarks AMOCO 4005 and AMOCO 4034 which are slit film woven polypropylene fabrics.

In summary, an approved method of manufacturing geosynthetic clay liners has been provided. The use of glue, adhesives and additional drawing steps have been eliminated. Woven geotextiles can be used for the primary carrier sheet as well as the cover sheet and no needle punching or quilting is necessary. Accordingly, an improved method of manufacture as well as an improved geosynthetic clay liner has been provided by the present invention.

Although only one method and one embodiment has been illustrated and described, it will at once be apparent to those skilled in the art that variations may be made within the spirit and scope of the present invention. Accordingly, it is intended that the scope of the invention be limited solely by the scope of the hereafter appended claims and not by any specific wording in the foregoing description.

We claim:

1. A geosynthetic clay liner formed by adhering granules of bentonite clay to inside surfaces of a carrier sheet and a cover sheet, without needle punching comprising:

a primary carrier sheet;

a cover sheet;

a layer of compressed bentonite granules disposed between the primary carrier and cover sheets, the compressed bentonite granules having a moisture content of between about 20 and about 30 weight percent to enable the bentonite granules to adhere to the inside surface of the carrier sheet and cover sheet, without needle punching.

2. The geosynthetic clay liner of claim 1, wherein the primary carrier sheet has an inside surface in contact with the compressed bentonite granules;

the cover sheet has an inside surface in contact with the compressed bentonite granules;

the inside surfaces of the cover sheet and the primary carrier sheet carrying fibers which extend from the respective inside surfaces and toward the compressed bentonite granules.

3. The geosynthetic clay liner of claim 2, wherein the bentonite is granular in form and having particle sizes distributed such that more than 90% are between 4 mesh and 16 mesh.

4. The geosynthetic clay liner of claim 1, wherein the liner is free of any added adhesive.

5. The geosynthetic clay liner of claim 1, wherein the liner is free of any added adhesive.

6. A geosynthetic clay liner formed by adhering granules of bentonite clay to inside surfaces of a carrier sheet and a cover sheet, without needle punching comprising:

a woven primary carrier sheet;

a woven cover sheet;

a layer of compressed bentonite granules disposed between the primary carrier and cover sheets, the compressed bentonite granules having a moisture content of between about 20 and about 30 weight percent to enable the bentonite granules to adhere to the inside surfaces of the carrier sheet and cover sheet, without needle punching.

7. The geosynthetic clay liner of claim 6, wherein the primary carrier sheet has an inside surface in contact with the compressed bentonite granules;

the cover sheet has an inside surface in contact with the compressed bentonite granules; and the inside surfaces of the cover sheet and the primary carrier sheet carry fibers which extend from the respective inside surfaces and toward the compressed bentonite granules.

8. The geosynthetic clay liner of claim 7, wherein the bentonite is granular in form and having particle sizes distributed such that more than 90% are between 4 mesh and 16 mesh.

9. The geosynthetic clay liner of claim 6, wherein the liner is free of any added adhesive.

10. The geosynthetic clay liner of claim 1 further including rows of stitching extending between the primary carrier sheet and the cover sheet.

11. The geosynthetic clay liner of claim 6 further including rows of stitching extending between the primary carrier sheet and the cover sheet.

* * * * *